US006609775B1

(12) United States Patent
Moro et al.

(10) Patent No.: US 6,609,775 B1
(45) Date of Patent: Aug. 26, 2003

(54) RECORDING APPARATUS

(75) Inventors: Takahiro Moro, Wako (JP); Takeshi Matsushita, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/544,137

(22) Filed: Apr. 6, 2000

(30) Foreign Application Priority Data

Apr. 13, 1999 (JP) ..... 11-105866
Mar. 28, 2000 (JP) ..... 2000-089020

(51) Int. Cl.[7] ..... B41J 29/38; B65H 1/00
(52) U.S. Cl. ..... 347/14; 271/145
(58) Field of Search ..... 347/3, 14; 271/145, 271/171, 9.05, 9.06

(56) References Cited

U.S. PATENT DOCUMENTS 5,053,814 A * 10/1991 Takano et al. ..... 355/208
5,229,814 A * 7/1993 Hube et al. ..... 355/203
5,273,272 A * 12/1993 Nakamura et al. ..... 271/167
5,574,551 A * 11/1996 Kazakoff ..... 399/45
6,019,449 A * 2/2000 Bullock et al. ..... 347/14
2001/0011795 A1 * 8/2001 Otsuka et al. ..... 271/145

* cited by examiner

*Primary Examiner*—Hai Pham
*Assistant Examiner*—Alfred Dudding

(57) ABSTRACT

The present invention relates to a recording apparatus which has recording sheet discriminating means for discriminating a kind of the recording sheet to be supplied to the recording means, a printer driver for controlling a recording operation of the recording means on the basis of recording sheet an information of conforming to the kind of the recording sheet discriminated by the recording sheet discriminating means, judging means for judging whether the recording sheet of which the kind has been discriminated by the recording sheet discriminating means is included in of a preset specific kind recording sheet, and recording sheet information inputting means for inputting the information of the recording sheet to be supplied to the recording means when it is judged by the judging means that the recording sheet of which the kind has been discriminated is not included in the specific kind of recording sheets.

5 Claims, 5 Drawing Sheets

PLEASE SET INFORMATION OF RECORDING SHEET

| | | | |
|---|---|---|---|
| CONVEYANCE CHARACTERISTIC | ◦ PLAIN PAPER TYPE | | ◦ COATED PAPER TYPE |
| THICKNESS | ◦ THICK | ◦ NORMAL | ◦ THIN |
| ABSORPTIVITY OF INK | ◦ GOOD | ◦ NORMAL | ◦ BAD |

OK

RECORDING APPARATUS

BACKGROUND OF THE INVENTION

1. Field of the Invention

This invention relates to a recording apparatus such as a printer which can effect recording control conforming to the kind of a recording sheet.

2. Related Background Art

Recording apparatuses such as printers according to the prior art include apparatuses to the main body of which a sheet cassette containing recording sheets therein is detachably attachable. Various recording sheets such as plain paper, coated paper, OHP, cloth, postcards, thick paper and photographic paper can be contained in this sheet cassette. The sheet cassette is provided with recording sheet discriminating means for discriminating the kind of recording sheets contained therein.

In the recording apparatus, a printer driver installed, for example, in a computer is informed of the information of the kind of the recording sheet discriminated by the recording sheet discriminating means, and the printer driver controls the recording means of the recording apparatus so as to effect optimum recording by a recording operation matching the informed nature of the recording sheet.

In recent years, however, the kinds of recording sheets on which recording is effected by the recording apparatus have become diversified, and the data of recording sheets of specific kinds stored in the printer driver are limited, and when the recording sheets contained in the sheet cassette are not included in the recording sheets of specific kinds stored in the printer driver, the setting of the recording sheets cannot be effected and confusion has sometimes occurred.

For example, when a sheet cassette is used in common to recording apparatuses of plural kinds, the data of the recording sheets of specific kinds recorded in the printer driver for each recording apparatus may differ, and even if the printer driver is informed of the information of the kind of the recording sheets from the sheet cassette, there will arise a case where data conforming to that kind of the recording sheets are not stored in the printer driver.

SUMMARY OF THE INVENTION

The present invention has been made in view of the above-noted points, and the object thereof is to provide a recording apparatus in which when recording is to be effected on a recording sheet of which the kind cannot be specified, the information of the recording sheet can be inputted so as to prevent wrong printing.

The recording apparatus of the present invention has:

recording means for recording an image on a recording sheet;

recording sheet discriminating means for discriminating the kind of the recording sheet to be supplied to the recording means;

a printer driver for controlling the recording operation of the recording means on the basis of recording sheet information conforming to the kind of the recording sheet discriminated by the recording sheet discriminating means;

judging means for judging whether the recording sheet of which the kind has been discriminated by the recording sheet discriminating means is included in recording sheets of a preset specific kind; and recording sheet information inputting means for inputting the information of the recording sheet to be supplied to the recording means when it is judged by the judging means that the recording sheet of which the kind has been discriminated is not included in the recording sheets of the specific kind; and is characterized in that the printer driver controls the recording operation of the recording means on the basis of the recording sheet information inputted by the recording sheet information inputting means.

Also, the recording apparatus of the present invention has:

recording means for recording an image on a recording sheet;

kind of recording sheet inputting means for inputting whether the recording sheet to be supplied to the recording means is a specific kind or a non-specific kind;

a printer driver for controlling the recording means so as to perform the recording operation on the basis of recording sheet information conforming to the recording sheet of the specific kind when the recording sheet is inputted as the specific kind by the kind of recording sheet inputting means;

judging means for judging whether the information inputted by the kind of recording sheet inputting means is the specific kind or the non-specific kind; and recording sheet information inputting means for inputting the recording sheet information of the recording sheet of the non-specific kind to be supplied to the recording means when the information is judged to be the non-specific kind by the judging means; and is characterized in that the printer driver controls the recording operation of the recording means on the basis of the recording sheet information inputted by the recording sheet information inputting means.

DESCRIPTION OF THE PREFERRED EMBODIMENTS

A first embodiment of the present invention will first b described in detail with reference to the drawings.

Figures 1, 2:
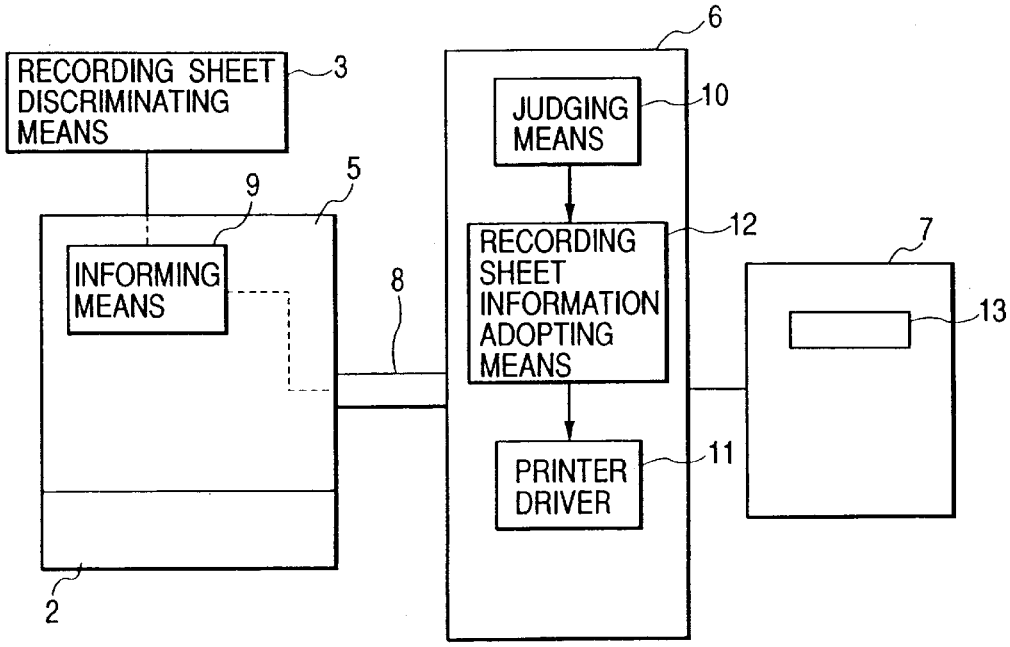
FIG. 1 is a front view showing special recording sheet information inputting means according to a first embodiment of the present invention.
FIG. 2 is a control block diagram showing an example in which the main body of a recording apparatus according to the first embodiment of the present invention and a computer are connected together.
Figure 3:
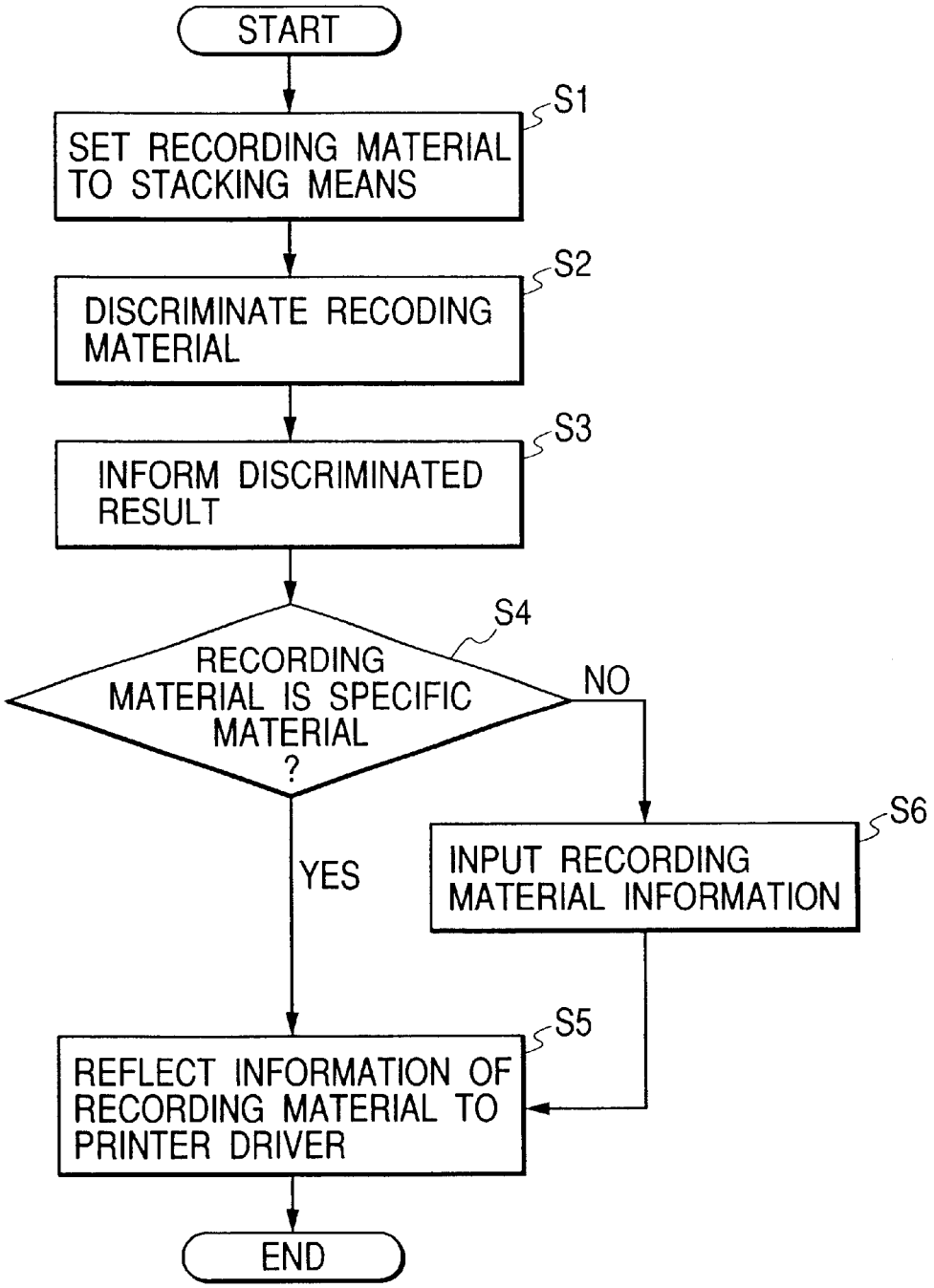
FIG. 3 is a flow chart showing the operation according to the first embodiment of the present invention.
Figure 4:
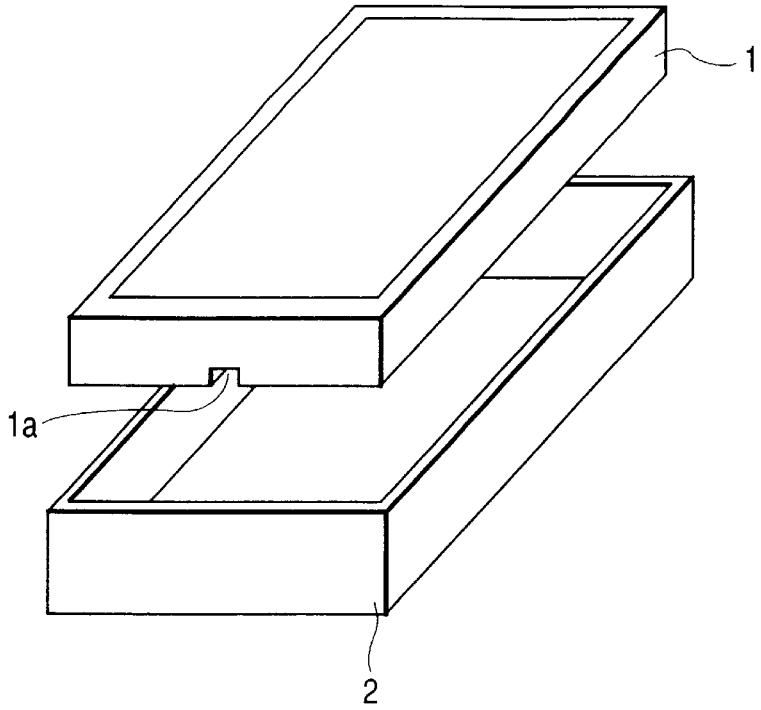
FIG. 4 is a perspective view separately showing recording sheet discriminating means according to an embodiment of the present invention.
Figure 5A:
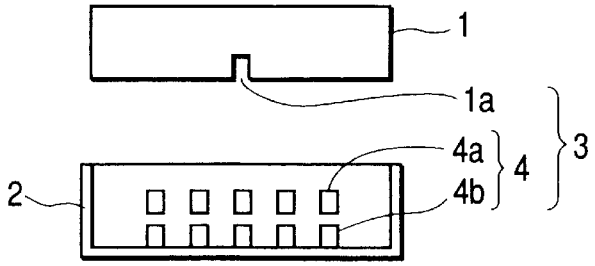
FIGS. 5A and 5B show the recording sheet discriminating means shown in FIG. 4, FIG. 5A being a side cross-sectional view showing a state in which the recording sheet discriminating means is separated, and FIG. 5B being a side cross-sectional view showing a state in which the recording sheet discriminating means is loosely inserted.
Figure 5B:
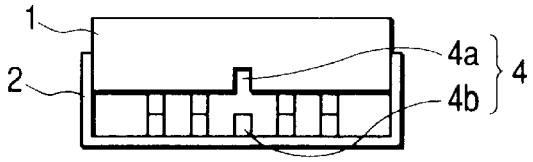
Figure 6:
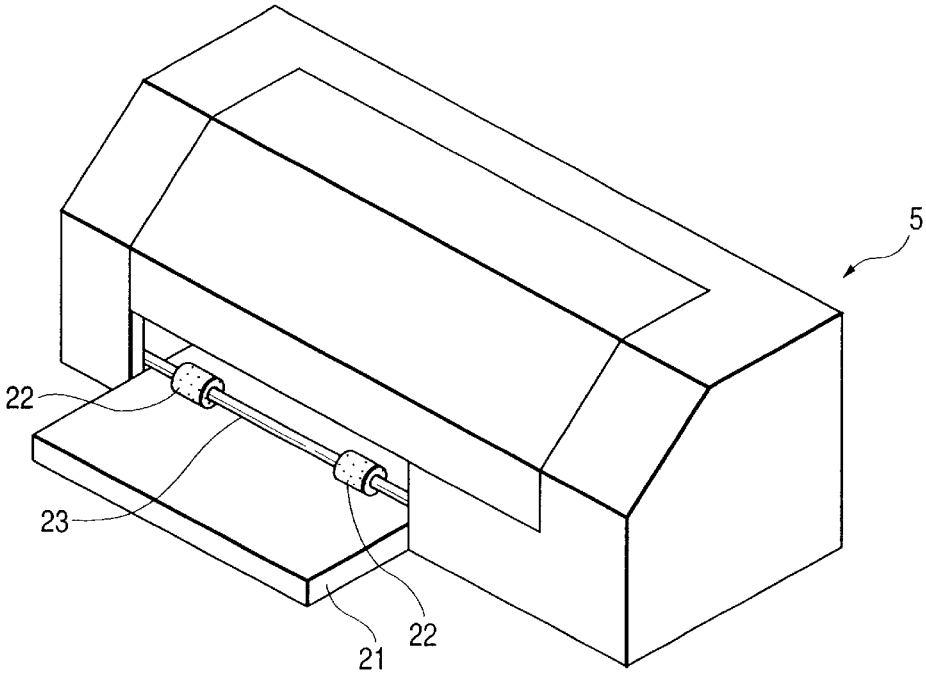
FIG. 6 is a perspective view of a recording apparatus according to an embodiment of the present invention.

FIG. 1 is a front view showing recording sheet information inputting means according to the first embodiment of the present invention, FIG. 2 is a control block diagram showing an example in which the main body of an apparatus and a computer are connected together, FIG. 3 is a flow chart of the control of the present invention, FIG. 4 is a perspective view showing a sheet cassette having recording sheet discriminating means, FIGS. 5A and 5B show the recording sheet discriminating means, FIG. 5A being a side cross-sectional view showing a state in which the recording sheet discriminating means is separated, FIG. 5B being a side cross-sectional view showing a state in which the recording sheet discriminating means is loosely inserted, and FIG. 6 is a perspective view showing a printer which is a recording apparatus to which the present invention is applied.

Referring to FIG. 4, the reference numeral 1 designated an inner cassette containing recording sheets and the reference numeral 2 designates an outer cassette on which the inner cassette 1 is mounted, and the inner cassette 1 and the outer cassette 2 together constitute a sheet cassette. The outer cassette 2 and the inner cassette 1 together also constitute recording sheet discriminating means 3 for discriminating which of recording sheets which are recording sheets of specific kinds such as plain paper, coated paper, OHP sheets, cloth, postcards, thick paper and photographic paper are set in the inner cassette 1.

That is, as shown in FIGS. 5A and 5B, the recording sheet discriminating means 3 is formed with a recess 1*a* at a different location in the bottom of the inner cassette 1 in conformity with the kind of the recording sheets, and the outer cassette 2 is provided with a plurality of switch means 4 selectively operated to be pushed by the bottom of the inner cassette 1 by the inner cassette 1 being mounted, thereby being changed over into ON state, or to be fitted into the recess 1*a*, thereby being maintained in OFF state. At least one recess 1*a* is formed in the bottom of inner cassette 1.

Also, the switch means 4 have a plurality of movable members 4*a* arranged, for example, in a row and sliding by the insertion and dismounting of the inner cassette 1 and stators 4*b* toward and away from which the movable members 4*a* are moved, and are switched on/off by the movable members 4*a* being moved toward and away from the stators 4*b*. By the plurality of switch means 4 being switched on/off, the kind of the sheets contained in the sheet cassette is discriminated.

With such a construction, the inner cassette 1 is fitted into the outer cassette 2, whereby the movable members 4*a* of any one or plural switch means 4 come into contact with the stators 4*b*. If design is made such that depending on the switch means 4 at what location has been switched on, the kind of the recording sheet is preset and this can be discriminated in control means which will be described later, the kind of the recording sheet can be specified by the switch means 4 switched on. That is, design is made such that a kind of sheet discrimination signal (kind of sheet information) corresponding to the switch means 4 switched on is discriminated in control means in the recording apparatus to thereby discriminate the kind of the recording sheet contained in the sheet cassette.

A recording apparatus (printer) 5 of the ink jet printing type to which the sheet cassette is detachably attachable will now be described with reference to FIG. 6. The interior of this recording apparatus 5 is provided with a printing head, not shown, for recording information on a sheet, a sheet feeding mechanism, a data processing portion, a power source portion, etc., and in the front lower portion thereof, there is installed a cassette receptacle (tray) 21 for mounting the sheet cassette thereon.

Above the cassette receptacle 21, a pair of right and left sheet supply rollers 22 are secured to a rotatable sheet feeding shaft 23. The sheet feeding shaft 23 is connected to a driving device, not shown.

Description will now be made of control means for discriminating the kind of the recording sheets.

Referring to FIG. 2, the reference numeral 5 designates a recording apparatus to which a sheet cassette containing recording sheets therein is mounted, the reference numeral 6 denotes a CPU as control means, the reference numeral 7 designates a display for inputting the kinds of recording sheets not included in recording sheets of specific kinds such as plain paper, postcard, coated paper, OHP sheet, thick paper, cloth and photographic paper, and the reference numeral 8 denotes a cable necessary when data are transmitted and received between the recording apparatus 5 and the CPU 6.

The recording apparatus 5 is provided with informing means 9 connected to the recording sheet discriminating means 3 when the sheet cassette is mounted, and by the informing means 9, the CPU 6 is informed of the kind of sheet information obtained from the recording sheet discriminating means 3.

Also, the CPU 6 is provided with judging means 10 for judging whether the kind of sheet information informed by the informing means 9 is included in the recording sheets of the preset specific kinds (in the present embodiment, the judging means 10 is provided in the CPU 6). The CPU 6 is further provided with recording sheet information adopting means 12 for automatically reflecting the kind of the sheet in a printer driver 11 when the kind of the recording sheet judged by the judging means 10 is a preset specific recording sheet.

Also, the CPU 6 has the function of calling upon the display 7 to display thereon special recording sheet information inputting means 13 for inputting the recording sheet information of a special recording sheet as shown in FIG. 1 when the kind of the recording sheet judged by the judging means 10 is not included in the information of the preset specific recording sheets.

As the cause of the fact that as described above, the kinds of the recording sheets contained in the sheet cassette are not stored in the CPU 6, it is considered that for example, when a sheet cassette is used in common to plural kinds of recording apparatuses, if the data of recording sheets of specific kinds recorded in the printer driver in each recording apparatus differ from one another, the kind of the recording sheets contained in the sheet cassette is not stored in the printer driver.

The user manually sets recording sheet information necessary to print on the recording sheets stacked on the inner cassette 1 from within the special recording sheet information inputting means 13 displayed on the display 7.

In the thus constructed apparatus, the CPU 6 is informed of the kind of sheet information from the recording sheet information informing means 9. Whether the kind of sheet information is included in the specific recording sheets is judged by the judging means 10 of the CPU 6. When it is judged to be a specific recording sheet, the kind of the recording sheet is reflected in the printer driver 11 by the use of the sheet information adopting means 12 installed in the CPU 6, and when it is judged to be not a specific sheet, the specific recording sheet information inputting means 13 shown in FIG. 1 is displayed on the display 7 to set the information of the sheet on the printer driver 11 for the user.

Accordingly, only when other recording sheets than the specific recording sheets are set in the sheet cassette, the user can manually input the kind of the special recording sheets and therefore, wrong printing can be prevented to the utmost.

FIG. 3 is a flow chart for illustrating the flow of the control of the recording apparatus according to the present embodiment, and this will hereinafter be described.

When the executes printing, the user first sets recording sheets in the sheet cassette (S1). Subsequently, the discrimination of the kind of the recording sheets set in the sheet cassette is effected by the recording sheet discriminating means 3 (S2). The judging means is informed of the information of the recording sheets outputted from the recording sheet discriminating means 3 (S3), and whether the recording sheets are recording sheets of a specific kind is discriminated (S4).

When as the result of the discrimination, the recording sheets are preset specific recording sheets, the information of the recording sheets is automatically reflected in the printer driver (S5). On the other hand, when as the result of the discrimination, the kind of the recording sheets cannot be discriminated, the special recording sheet information inputting means 13 for setting the recording sheet information of the special recording sheets set in the sheet cassette by the user is displayed, and the user inputs the recording sheet information (S6).

FIG. 1 shows an example of the display of the special recording sheet information inputting means 13.

The recording sheet information is parameters representative of the features of the recording sheet necessary for the control of printing, which include the conveyance characteristic, thickness and absorptivity (absorption rate) of ink of the recording sheet, and the use or non-use of a blur mitigating agent.

The conveyance characteristic of the recording sheet is concerned with the number of rotations, rotation pattern and torque control of the sheet feeding roller, and these parameters are particularly important when a recording sheet like coated paper having a smooth surface is fed. For example, the number of rotations is controlled in conformity with the surface state (e.g. slipperiness) of the recording sheet to thereby adjust the amount of feed, or the torque is controlled to thereby adjust the conveying force.

The thickness of the recording sheet, like the conveyance characteristic, is concerned with the control of the torque of the sheet feeding roller and the distance between a printing head and the paper. Unless appropriate setting is effected to the thickness of the recording sheet, bad sheet feeding may occur or the printing head and the paper may contact with each other to thereby injure the printing head. So, for example, the user can be informed by display or the like so as to manually adjust the distance between the recording sheet and the printing head, or the distance between the recording sheet and the printing head can be automatically adjusted in conformity with the thickness of the recording sheet.

The absorptivity of ink determines the amount of ejection of ink into the recording sheet, and by this, a controlling method for color treatment is varied. Unless the absorptivity of ink is appropriately set, the printer may in some cases eject an amount of ink exceeding the tolerance of the recording sheet, whereby colors may be blurred and further, the recording sheet may get twisted and contact with the printing head to thereby injure the printing head.

The blur mitigating agent, if used for recording sheets liable to blur, will mitigate the blur of ink, but depending on recording sheets, the solvent is not fixed, but conversely is secured to the printing head, thus causing bad printing. So, it is set so as to optimally effect the amount of ejection of ink in conformity with the absorptivity of ink of the recording sheet.

It is also possible to preserve these set values in memory means such as a file or a flash ROM at any time for each recording sheet, and for the user to call out them as required to thereby decrease the time and labor required for the setting of the parameters.

Lastly, at S5, the printer driver is informed of the recording sheet information set at S6 by the user, and the printer driver utilizes this recording sheet information for the control of the printer and effects the optimum control of printing.

The recording apparatus of the present invention is controlled along the above-described flow.

In this embodiment, when for example, a sheet cassette is used in common to plural kinds of recording apparatuses, the data of recording sheets of specific kinds recorded in the printer driver in each recording apparatus may differ from one another, and this is effective in a case where even if the printer driver is informed of the information of the kind of the recording sheet from the sheet cassette, data conforming to the kind of that recording sheet are not stored in the printer driver.

A second embodiment of the present invention will now be described. In the description of this second embodiment, the same constructions as those of the aforedescribed first embodiment need not be described, but different constructions will be described in detail.

Figure 7:
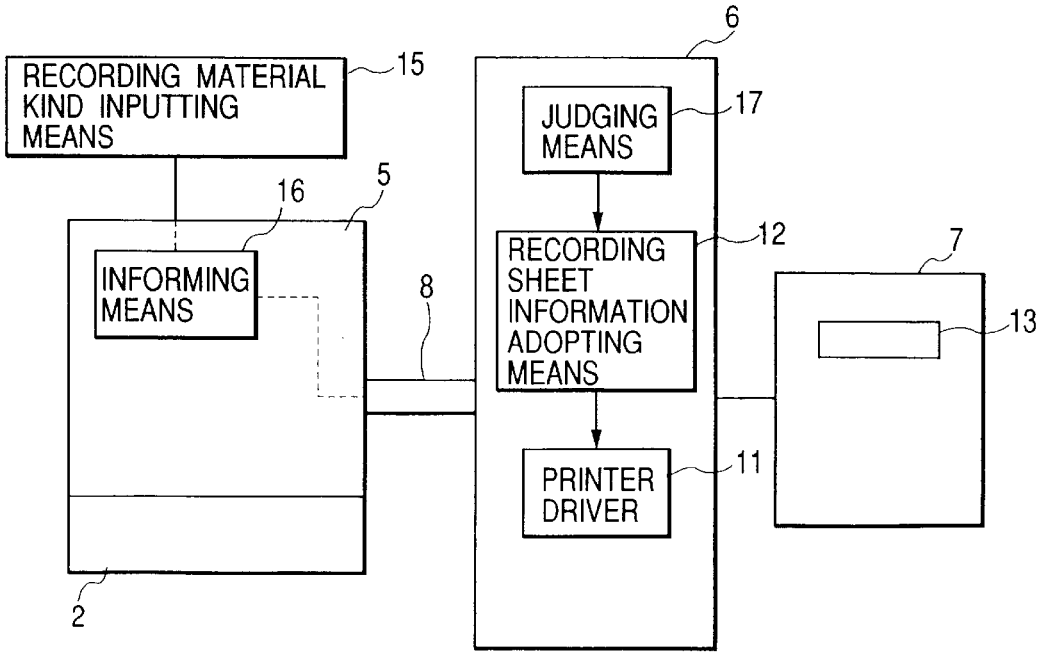
FIG. 7 is a control block diagram showing an example in which the main body of a recording apparatus according to a second embodiment of the present invention and a computer are connected together.

The present embodiment, as shown in FIG. 7, has recording sheet kind inputting means 15 for inputting whether the recording sheet to be supplied to the recording means is a specific kind or a non-specific kind, and a CPU 6 which is control means is informed of the result of the input of this recording sheet kind inputting means 15 by informing means 16.

Also, the CPU 6 is provided with judging means 17 for judging whether the information inputted by the recording sheet kind inputting means 15 is a specific kind or a non-specific kind.

In the CPU 6, there is provided recording sheet information adopting means 12 for automatically reflecting the kind of the sheet in a printer driver 11 when the recording sheet is judged to be a specific kind by the judging means 17. Thereby, the printer driver 11 controls the recording means so as to perform the recording operation on the basis of recording sheet information conforming to a recording sheet of a specific kind.

Also, provision is made of special recording sheet information inputting means 13 for inputting the recording sheet information of a recording sheet of a non-specific kind to be supplied to the recording means when the recording sheet is judged to be a non-specific kind by the judging means 17.

This special recording sheet information inputting means 13 is displayed on the display 7, as in the first embodiment, and the user manually sets recording sheet information necessary to print on a recording sheet of a non-specific kind by the special recording sheet information inputting means 13 being displayed.

The printer driver 11 controls the recording operation of the recording means on the basis of the recording sheet information inputted by the special recording sheet information inputting means 13.

As recording sheet kind inputting means 15 for inputting whether the recording sheet to be supplied to the recording means is a specific kind or a non-specific kind, an inner cassette (not shown) exclusively for containing recording sheets of non-specific kinds therein can be provided, for example, in the sheet cassette described in the first embodiment, and when the user is to effect recording on recording sheets of a non-specific kind, the user can use the inner cassette.

Thereby, when the inner cassette 1 containing recording sheets of a non-specific kind therein is inserted into the outer cassette 2, a signal that the recording sheet is a recording sheet of a non-specific kind is outputted, and the recording sheet is judged to be a recording sheet of a non-specific kind by the judging means, and the special recording sheet information inputting means 13 is displayed on the display 7.

Also, another type of the recording sheet kind inputting means 15 may be one which is provided with a switch for selecting the specific kind of the recording sheets, and a switch for selecting the non-specific kind of the recording sheets, and in which when recording is to be effected on the recording sheets of the specific kind, the switch for the recording sheets of the specific kind is selected and switched on, and when recording is to be effected on the recording sheets of the non-specific kind, the switch for the non-specific kind is switched on to thereby input. In this case, as the means for containing the sheets therein, besides the sheet cassette, means of a type which sets sheets on a tray can also be applied.

Figure 8:
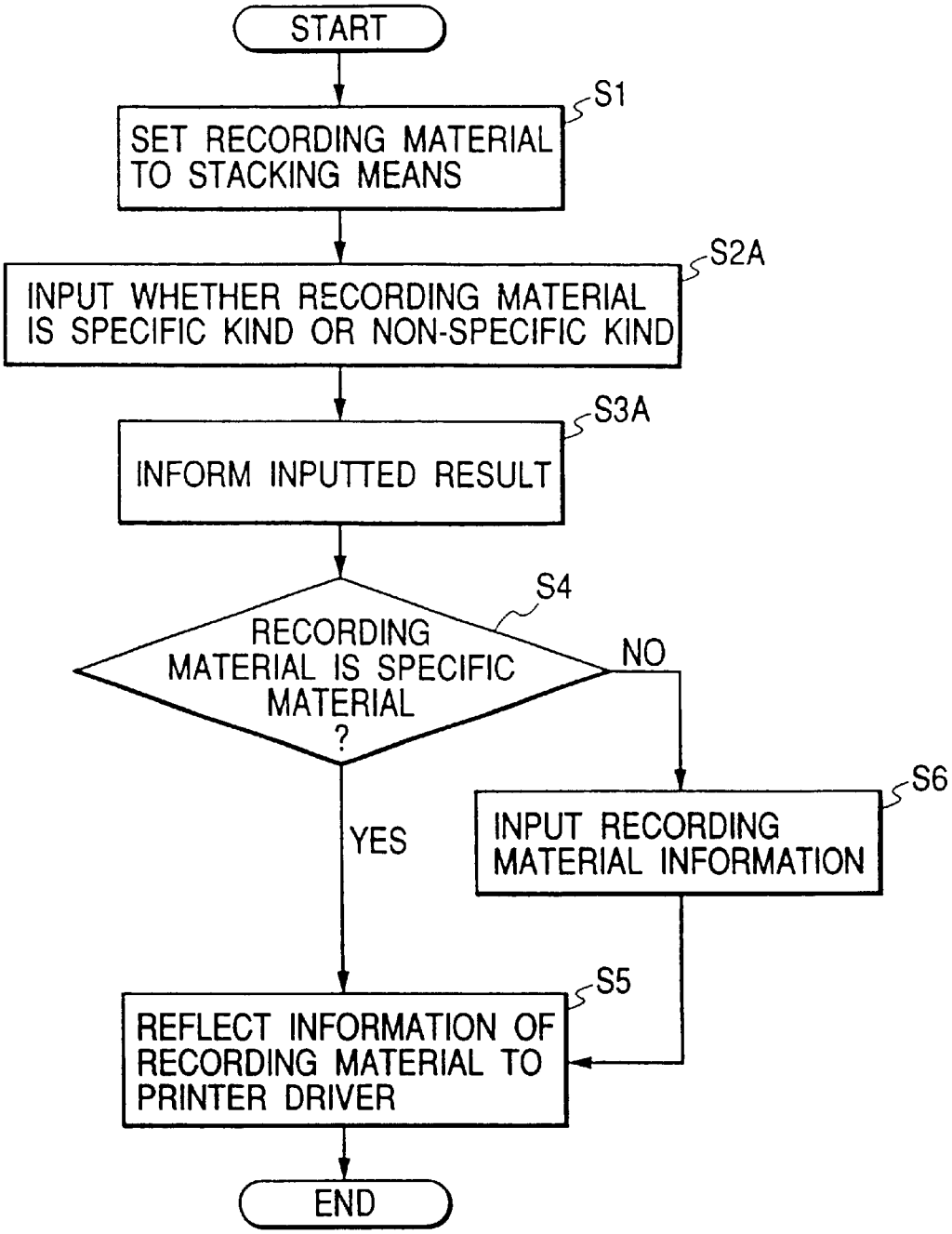
FIG. 8 is a flow chart showing the operation according to the second embodiment of the present invention.

FIG. 8 is a flow chart for illustrating the flow of the control of the recording apparatus according to this second embodiment, and this flow chart differs in the step 2 (S2A) and the step 3 (S3A) from the flow chart of FIG. 3. The step 2 is the step of inputting the kind of the recording sheet by the recording sheet kind inputting means 15, and the step 3 is the step of informing the CPU 6 of the information inputted by the recording sheet kind inputting means 15. The other steps are substantially the same as those in the flow chart of FIG. 3.

The embodiments of the present invention have been described above in detail, and in the foregoing embodiments, description has been made of a construction in which a sheet cassette can be mounted on the recording apparatus, but the present invention may be applied to a recording apparatus designed such that a plurality of sheet cassette containing recording sheets of different kinds therein are mounted and the recording sheets can be selectively supplied to recording means, whereby the recording sheet information of a recording sheet may be inputted to a sheet cassette containing recording sheets of not a specific kind therein by special recording sheet information inputting means to thereby effect optimum printing.

While in the present embodiment, the switch means 4 is switched on or off and an electric current is flowed to thereby specify the recording sheet, the recording sheet can be specified by the use, for example, of a bar-code sensor.

Also, in the above-described embodiments, the exchange of the data between the recording apparatus 5 and the CPU 6 is effected by the cable 9, but besides wire communication, the exchange of the data may of course be effected by wireless communication such as infrared ray (IrDA).

As described above, according to the present invention, the kind of a recording sheet is discriminated by the recording sheet discriminating means, and when the recording sheet information is judged to be not a specific kind by the judging means, the information of the recording sheet is inputted by the special recording sheet information inputting means and therefore, wrong printing can be prevented and an accurate recording operation can be performed.

Also, whether a recording sheet is a specific kind or a non-specific kind is inputted by the recording sheet kind inputting means and the inputted information is discriminated by the judging means, and when it is judged to be the non-specific kind, the information of the recording sheet is inputted by the special recording sheet information inputting means and therefore, wrong printing can be prevented and an accurate recording operation can be performed.

What is claimed is:

1. A recording apparatus for effecting a record on a recording sheet with recording means, comprising:

a sheet cassette detachably attached to said recording apparatus and containing the recording sheet, said sheet cassette including an inner cassette containing the recording sheet and an outer cassette to which said inner cassette is attached;

sheet discriminating means for discriminating a kind of recording sheet contained in said sheet cassette, said sheet discriminating means outputting a sheet discrimination signal when said inner cassette containing the recording sheet is attached to said outer cassette;

control means for controlling a recording operation of said recording means on the basis of sheet information conforming to the kind of the recording sheet discriminated by said sheet discriminating means;

judging means for judging whether the kind of the recording sheet discriminated by said sheet discriminating means is one of a preset specific kind of the recording sheet; and sheet information inputting means for inputting the sheet information of the recording sheet when it is judged by said judging means that the recording sheet is not one of the specific kind of the recording sheet, wherein said control means controls the recording operation of said recording means on the basis of the sheet information inputted by said sheet information inputting means when it is judged by said judging means that the recording sheet is not one of the specific kind of recording sheet.

2. A recording apparatus for effecting a record on a recording sheet with recording means, comprising:

sheet discriminating means for discriminating a kind of recording sheet to be supplied to said recording means;

control means for controlling a recording operation of said recording means on the basis of sheet information conforming to the kind of the recording sheet discriminated by said sheet discriminating means;

judging means for judging whether the kind of the recording sheet discriminated by said sheet discriminating means is one of a preset specific kind of the recording sheet; and sheet information inputting means for inputting the sheet information of the recording sheet when it is judged by said judging means that the recording sheet is not one of the specific kind of the recording sheet, wherein said control means controls the recording operation of said recording means on the basis of the sheet information inputted by said sheet information inputting means when it is judged by said judging means that the recording sheet is not one of the specific kind of recording sheet.

3. A recording apparatus for effecting a record on a recording sheet with recording means, comprising:

sheet kind inputting means for inputting whether a recording sheet to be supplied to said recording means is a preset specific kind or a non-specific kind;

control means for controlling a recording operation of said recording means on the basis of a sheet information conforming to a kind of the specific kind of the recording sheet when it is inputted by said sheet kind inputting means that the recording sheet is the specific kind; and sheet information inputting means for inputting the sheet information of the recording sheet when it is inputted by said sheet kind inputting means that the recording sheet is the non-specific kind, wherein said control means controls the recording operation of said recording means on the basis of the sheet information inputted by said sheet information inputting means when it is inputted by said sheet kind inputting means that the recording sheet is the non-specific kind.

4. A recording apparatus according to claim 2, wherein said sheet information inputting means is capable of setting at least one of a conveyance characteristic, thickness and absorptivity of ink of the recording sheet.

5. A recording apparatus according to claim 3, wherein said sheet information inputting means is capable of setting at least one of a conveyance characteristic, thickness and absorptivity of ink of the recording sheet.

* * * * *

UNITED STATES PATENT AND TRADEMARK OFFICE

CERTIFICATE OF CORRECTION

PATENT NO. : 6,609,775 B1
DATED : August 26, 2003
INVENTOR(S) : Takahiro Moro et al.

It is certified that error appears in the above-identified patent and that said Letters Patent is hereby corrected as shown below:

Title page,
Insert Item -- [74] *Attorney, Agent, or Firm* - Fitzpatrick, Cella, Harper & Scinto --.
Item [57], ABSTRACT,
Line 10, "of" should be deleted.

Column 2,
Line 66, "b" should read -- be --.

Column 8,
Line 18, "attached" should read -- attachable --.

Signed and Sealed this

Thirteenth Day of January, 2004

JON W. DUDAS
*Acting Director of the United States Patent and Trademark Office*